US007029332B2

(12) United States Patent
Chien

(10) Patent No.: US 7,029,332 B2
(45) Date of Patent: Apr. 18, 2006

(54) FLAT PLUG STRUCTURE

(76) Inventor: Chao Chuan Chien, 8F, No.387, Chung Cheng Road, Hsin Chuang City, Taipei Hsien (TW)

( * ) Notice: Subject to any disclaimer, the term of this patent is extended or adjusted under 35 U.S.C. 154(b) by 0 days.

(21) Appl. No.: 10/791,697

(22) Filed: Mar. 4, 2004

(65) Prior Publication Data

US 2005/0197013 A1 Sep. 8, 2005

(51) Int. Cl.
*H01R 13/68* (2006.01)

(52) U.S. Cl. ..... 439/622; 439/106; 439/954

(58) Field of Classification Search ..... 439/622, 439/621, 106, 954
See application file for complete search history.

(56) References Cited

U.S. PATENT DOCUMENTS 3,975,075 A * 8/1976 Mason ..... 439/107
4,679,884 A * 7/1987 Klemp ..... 439/106
4,738,639 A * 4/1988 Henderson ..... 439/622
4,834,664 A * 5/1989 Lin ..... 439/145
5,137,473 A * 8/1992 Nickola ..... 439/622
5,475,445 A * 12/1995 Yamaguchi et al. ..... 348/663
5,876,250 A * 3/1999 Deng ..... 439/622
6,190,207 B1 * 2/2001 Wang ..... 439/622
6,267,627 B1 * 7/2001 Lin ..... 439/622
6,547,600 B1 * 4/2003 Yen ..... 439/622

* cited by examiner

*Primary Examiner*—Gary F. Paumen
(74) *Attorney, Agent, or Firm*—Troxell Law Office, PLLC

(57) ABSTRACT

The present invention provides a flat plug structure, which comprises: a flat housing, having a space; a first conductive plate, positioned perpendicularly inside said space and protruded from the bottom of said housing; a second conductive plate, also positioned perpendicularly inside said space and protruded from the bottom of said housing; a fuse seat, positioned inside said space and beside said second conductive plate; and a bottom plate, is made of an insulator material for carrying said fuse seat and removable covers over said space of said flat housing.

10 Claims, 9 Drawing Sheets

FLAT PLUG STRUCTURE

FIELD OF THE INVENTION

The present invention relates generally to a plug structure. More particularly, the present invention relates to a flat plug structure that has a flat housing. It has a very thin thickness when the flat plug is inserter into an outlet. It also has a specific angle so that when the flat plug is inserted into the outlet it will not block the other outlets.

BACKGROUND OF THE INVENTION

Generally, the plug structure of the prior art has a certain thickness. When the plug structure of the prior art is inserted into an outlet on the wall, due to the thickness of the plug structure itself, the plug structure will protrude from the wall about 3~5 cm. The 3~5 cm thickness will block the furniture for example but not limited to a cabinet aligning to the wall, thus will obstruct the whole view of the interior decoration, also, due to the plug being compressed by the furniture for a long time, it also can easy malfunction.

For example, U.S. Pat. No. 4,679,884 "A FUSED ELECTRICAL APPLIANCE PLUG" which teaches a fused electrical appliance plug. However, the plug of this patent still has a certain thickness, therefore, it cannot improve the aforesaid drawback of the prior art.

For example, U.S. Pat. No. 5,137,473 "A FUSED PROTECTION DEVICE" which teaches a fused protection device that cascades a fused protection device between a plug and an outlet and uses the fused protection device to protect the electric appliance coupled to the plug. However, due to the plug already having a certain thickness and then cascades to the fused protection device, thus will make the plug cascaded with the fused protection device further protruding from the wall, therefore the fused protection device of this patent still cannot improve the aforesaid drawback of the prior art.

Furthermore, some flat power plug products can be seen in the market, however, these flat power plug products do not have the function of changing the fuse, therefore, these flat power plug products cannot provide the over current protection function to the coupled appliance.

Therefore, it needs a flat plug structure that has a flat housing and a very thin thickness when the flat plug is inserted into an outlet. It also has a specific angle so that when the flat plug is inserted into the outlet it will not block the other outlets.

SUMMARY OF THE INVENTION

To solve the above problems, it is an object of the present invention to provide a flat plug structure that has a flat housing. It has a very thin thickness when the flat plug is inserted into an outlet.

To accomplish the above object of the present invention, there is provided a flat plug structure, which comprises: a flat housing, having a space; a first conductive plate, positioned perpendicularly inside the space and protruded from the bottom of the housing, having a first containing slot for containing and fixing a first conductive wire of a power cable; a second conductive plate, also positioned perpendicularly inside the space and protruded from the bottom of the housing, having a second containing slot for containing and fixing a first end of a fuse, wherein, the second conductive plate is parallel to the first conductive plate, and has a specific distance between them so as to be inserted into an outlet; a fuse seat, positioned inside the space and beside the second conductive plate, having a third containing slot and a fourth containing slot, wherein, the third containing slot is used to contain and fix a second end of the fuse, and the fourth containing slot is used to contain and fix a second conductive wire of the power cable; and a bottom plate, is made of an insulator material for carrying the fuse seat and removable covers over the space of the flat housing.

To solve the above problems, it is another object of the present invention to provide a flat plug structure that has a flat housing. It has a specific angle when the flat plug is inserted into the outlet it will not block the other outlets.

To accomplish the above object of the present invention, there is provided a flat plug structure, which comprises: a flat housing, having a space; a first conductive plate, positioned perpendicularly inside the space and protruded from the bottom of the housing, having a first containing slot for containing and fixing a first conductive wire of a power cable; a second conductive plate, also positioned perpendicularly inside the space and protruded from the bottom of the housing, having a second containing slot for containing and fixing a first end of a fuse, wherein, the second conductive plate is parallel to the first conductive plate, and has a specific distance between them so as to be inserted into an outlet; a fuse seat, positioned inside the space and beside the second conductive plate, having a third containing slot and a fourth containing slot, wherein, the third containing slot is used to contain and fix a second end of the fuse, and the fourth containing slot is used to contain and fix a second conductive wire of the power cable; and a bottom plate, is made of an insulator material for carrying the fuse seat and removable covers over the space of the flat housing.

The novel features of the invention are set forth with particularity in the appended claims. The invention will be best understood from the following description when read in conjunction with the accompanying drawings.

DESCRIPTION OF THE PREFERRED EMBODIMENTS

Figure 1A:
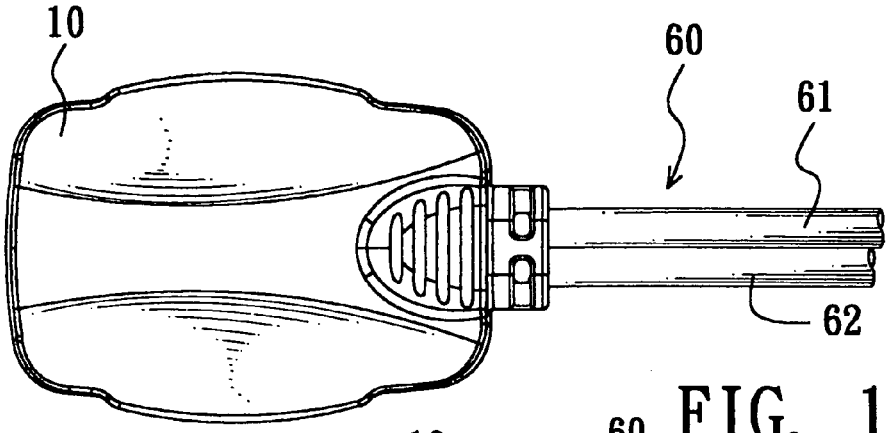
FIGS. 1(*a*)~1(*c*) which respectively shows a top view, side view and bottom view of a flat plug structure in accordance with one embodiment of the present invention.
Figure 1B:
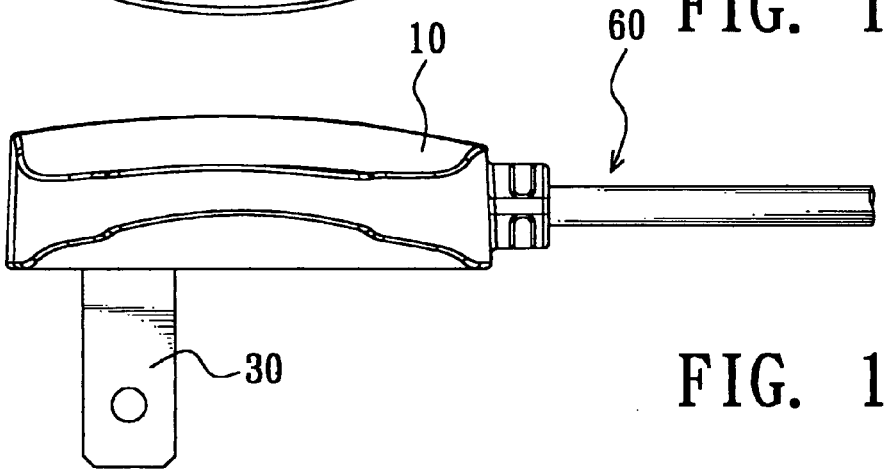
Figure 1C:
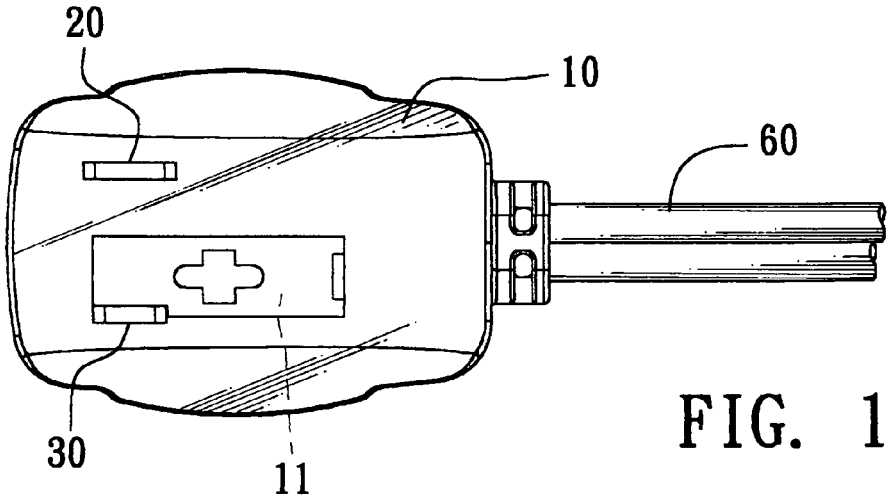

Referring to FIGS. 1(*a*)~1(*c*), which respectively shows a top view, side view and bottom view of a flat plug structure in accordance with one embodiment of the present invention. As shown in FIGS. 1(*a*)~1(*c*), the flat plug structure of the present invention comprises: a flat housing 10; a first conductive plate 20; a second conductive plate 30; a fuse seat 40 and a bottom plate 50. Whereby, the flat plug structure of the present invention can have a very thin thickness when the flat plug is inserted into an outlet. Wherein, the flat housing 10, first conductive plate 20 and the second conductive plate 30 are made by molding method so as to achieve the goals of the most thin and conveniently to be assembled.

Wherein, the shape of the flat housing 10 is for example but not limited to a square shape and has a space 11 for positioning the fuse seat 40. The space 11 is located beside the second conductive plate 30 and parallel to the second conductive plate 30. Thus the flag plug of the present invention can parallel to the outlet when it is inserted into the outlet. The bottom plate 50 is made by an insulator for example but not limited to plastic, for carrying the fuse seat 40 and can be removable covered the space 11.

Figure 2A:
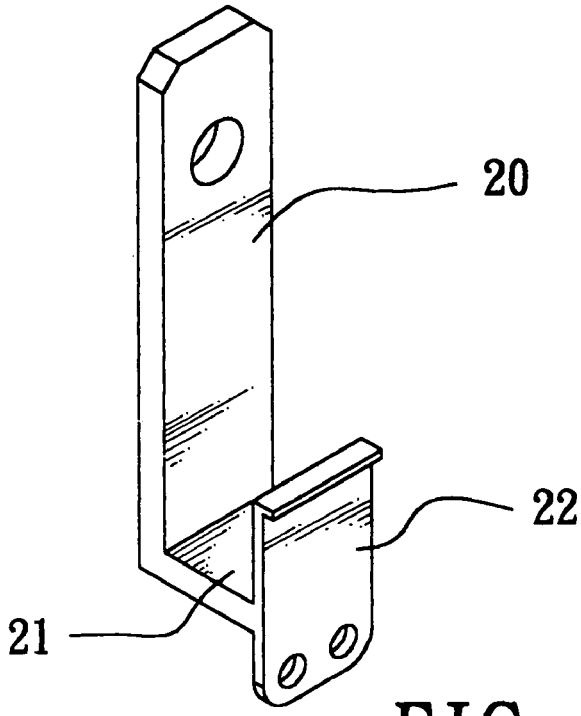
FIGS. 2(*a*)~2(*b*) which respectively shows a side view of the first conductive plate and the second conductive plate in accordance with one embodiment of the present invention.
Figure 2B:
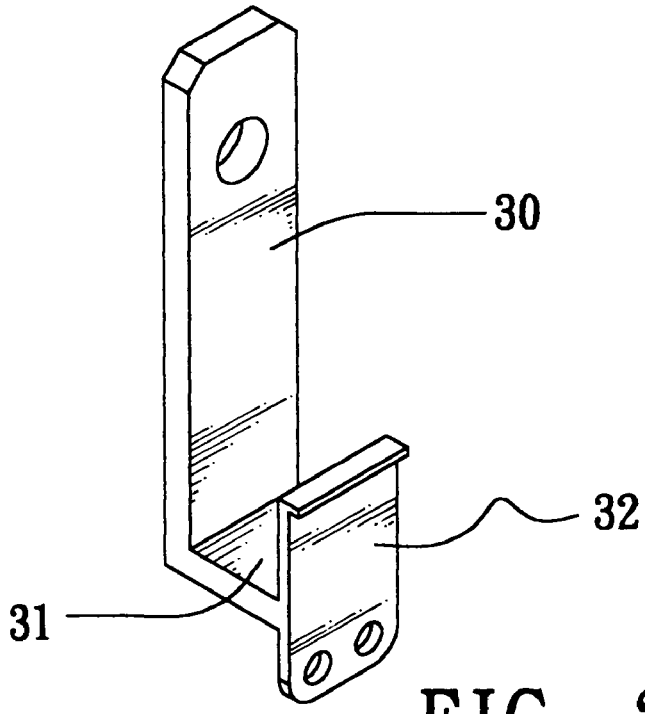

Referring to FIGS. 2(*a*)~2(*b*), which respectively shows a side view of the first conductive plate 20 and the second conductive plate 30 in accordance with one embodiment of the present invention. As shown in FIG. 2(*a*), the first conductive plate 20 of the present invention is positioned perpendicularly inside said space 11 and protruded from the bottom of said housing 10 and has a first containing slot 21 for containing and fixing a first conductive wire 61 of a power cable 60. Wherein, the first containing slot 21 extends right a certain distance from the bottom of said first conductive plate 20 to form a bottom of said first containing slot 21 and then extends from two sides of said bottom of said first containing slot 21 to form the walls 22 of said first containing slot 21. The second conductive plate 30 has walls 32 and a second containing slot 31 with a width of said bottom is just wide enough to contain the fuse 70.

As shown in FIG. 2(*b*), the second conductive plate 30 of the present invention is also positioned perpendicularly inside said space 11 and protruded from the bottom of said housing 10 and has a second containing slot 31 for containing and fixing a first end of the fuse 70. Wherein, the second conductive plate 30 is parallel to the first conductive plate 20 and has a specific distance between them so that the second conductive plate 30 and the first conductive plate 20 can conveniently be inserted into the outlet (not shown).

Figure 3A:
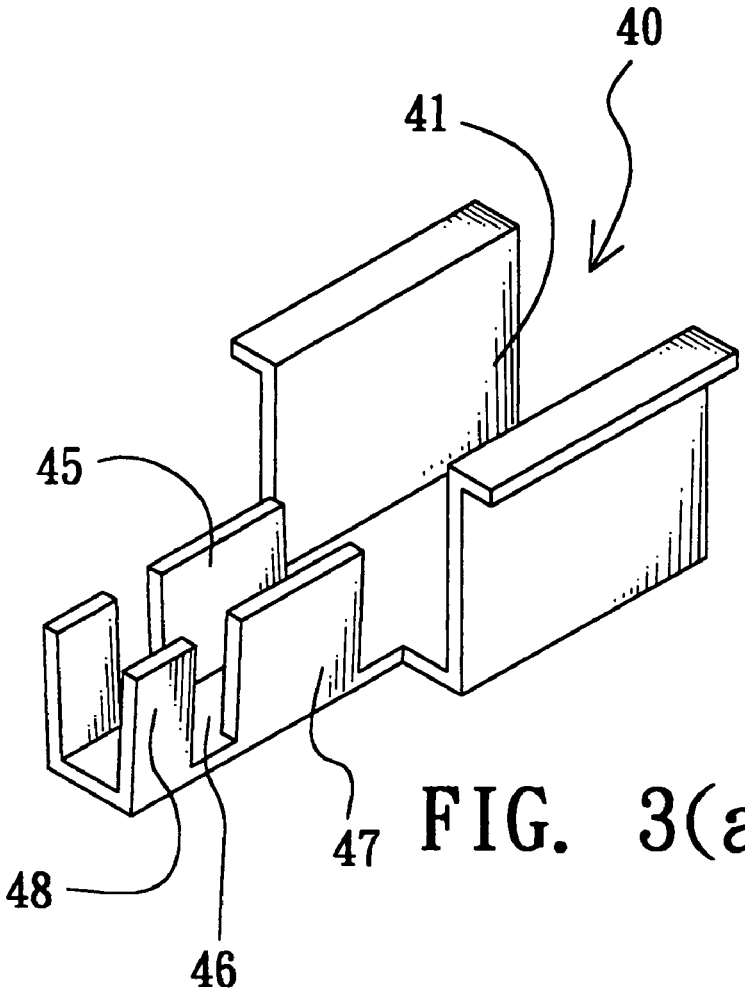
FIGS. 3(*a*)~3(*b*) which respectively shows a top view, side view and bottom view of the fuse seat in accordance with one embodiment of the present invention.
Figure 3B:
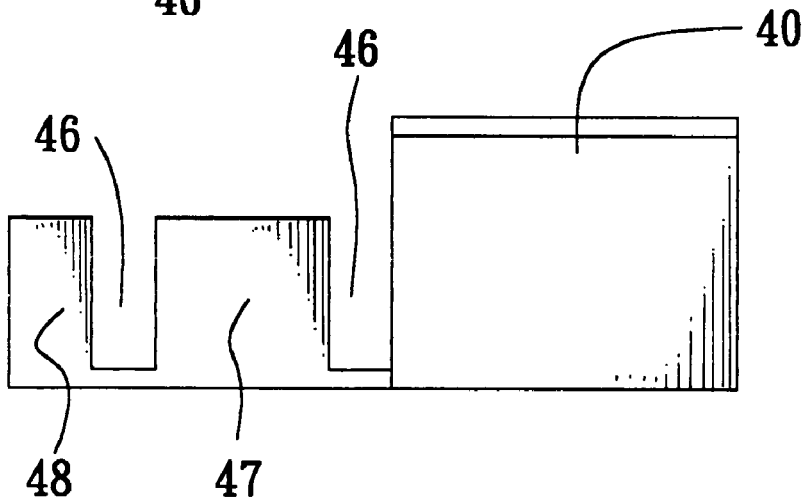

Referring to FIGS. 3(*a*)~3(*b*), which respectively shows a top view, side view and bottom view of the fuse seat 40 in accordance with one embodiment of the present invention. As shown in FIGS. 3(*a*)~3(*b*), the fuse seat 40 of the present invention is positioned inside the space 11 and beside the second conductive plate 30, which comprises a third containing slot 41 and a fourth containing slot 45, wherein, the third containing slot 41 is used to contain and fix a second end of said fuse 70, and said fourth containing slot 45 is used to contain and fix a second conductive wire 62 of said power cable 60. The third containing slot 41 is a U-shaped, and extends forward from the approximately central of the U-shaped bottom to form a U-shaped fourth containing slot 45, and two walls of said fourth containing slot 45 respectively has a opening 46, thus, each walls of said fourth containing slot 45 respectively has a first clip 47 and a second clip 48 so as to fasten said second conductive wire 62 of said power cable 60 by said first clip 47 and second clip 48. Furthermore, the widths of said first containing slot, second containing slot and third containing slot are about and bigger than the width of said fourth containing slot 45.

Figure 4:
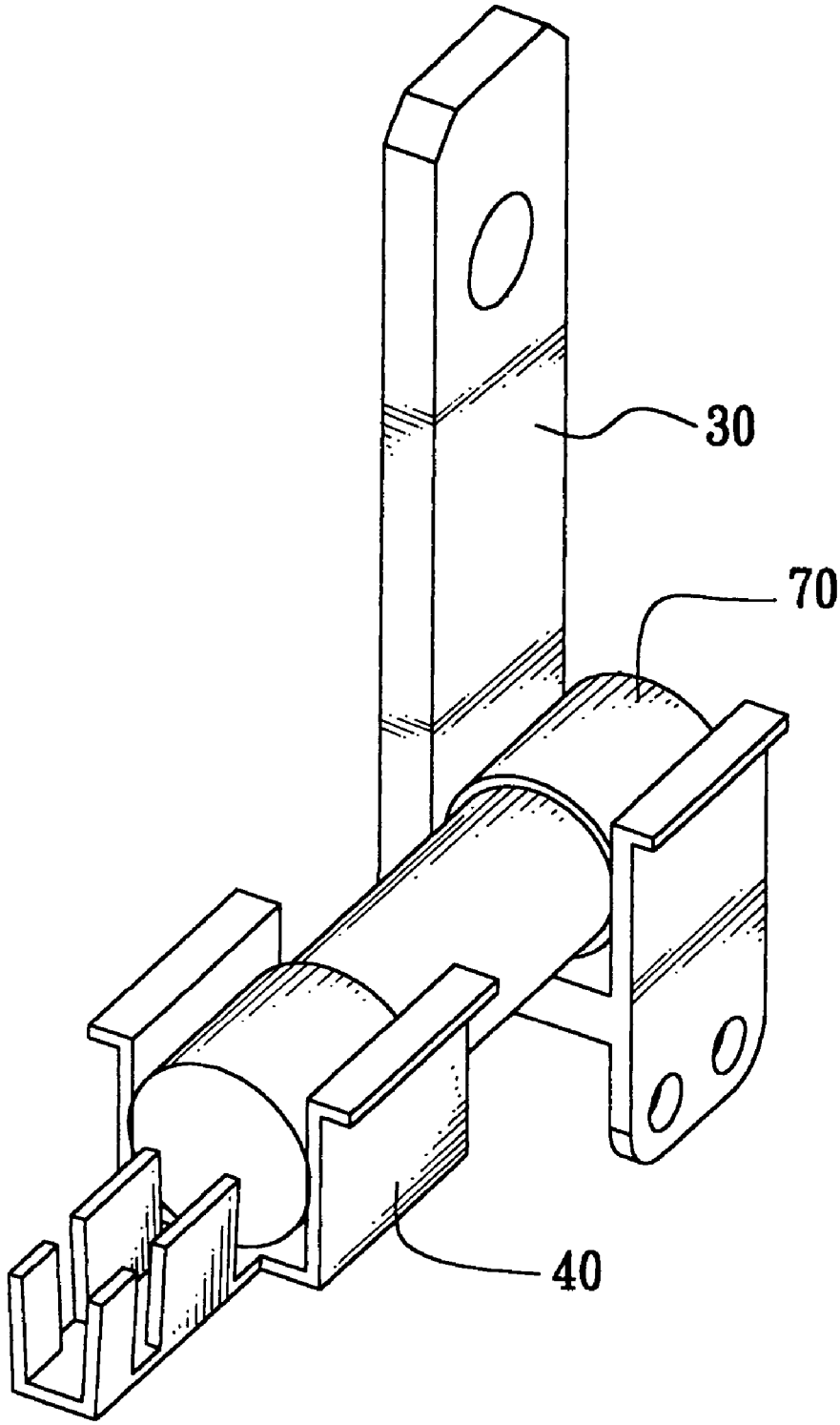
FIG. 4 which shows a combination view of the fuse seat, second conductive plate and the fuse in accordance with one embodiment of the present invention.

Referring to FIG. 4, which shows a combination view of the fuse seat 40, second conductive plate 30 and the fuse 70 in accordance with one embodiment of the present invention. As shown in FIG. 4, During assembling, one end of the fuse 70 can be positioned inside the second containing slot 31; another end of the fuse 70 is positioned inside the third containing slot 41; and the second conductive wire 62 of said power cable 60 is positioned inside the fourth containing slot 45 and fastened by said first clip 47 and second clip 48; finally, the bottom plate 50 covers the space 11 so that the flat plug is completely assembled.

Figure 5A:
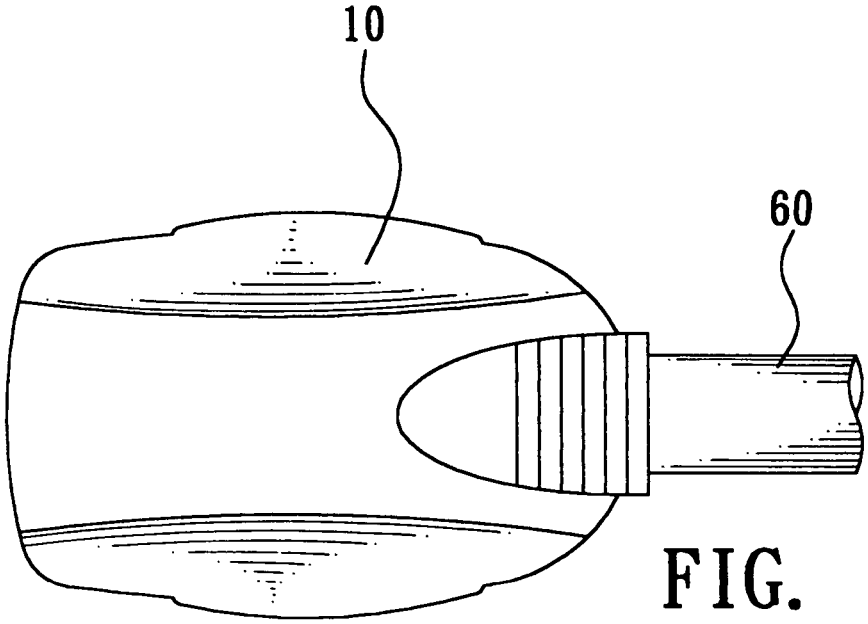
FIGS. 5(*a*)~5(*c*) which respectively shows a top view, side view and bottom view of a flat plug structure in accordance with another embodiment of the present invention.
Figure 5B:
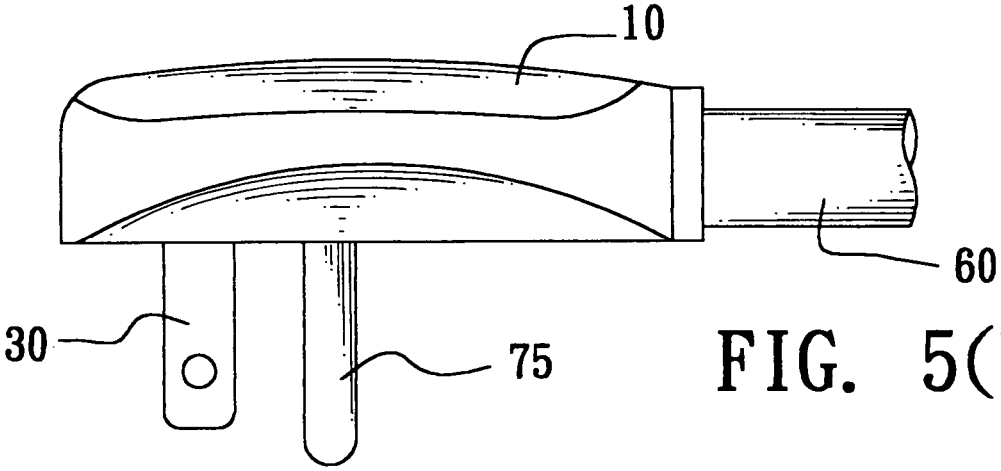
Figure 5C:
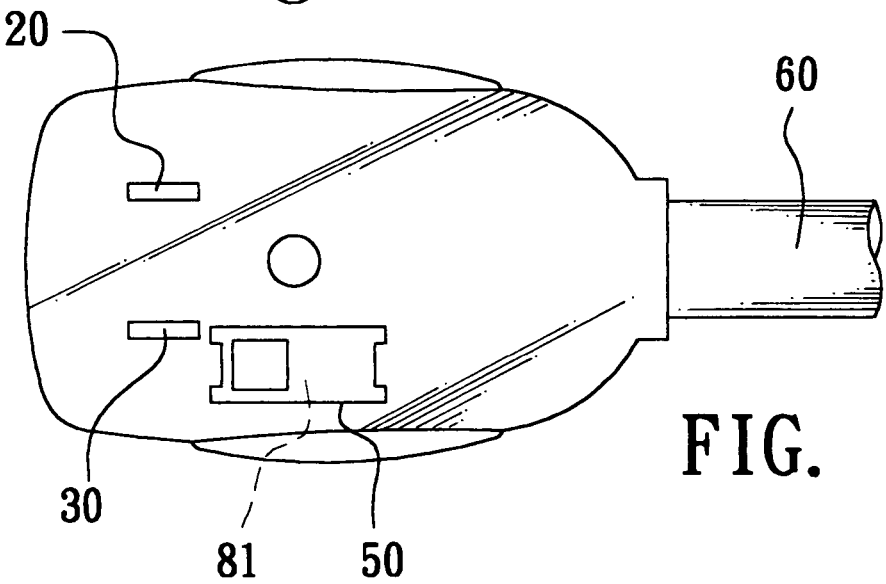

Referring to FIGS. 5(*a*)~5(*c*), which respectively shows a top view, side view and bottom view of a flat plug structure in accordance with another embodiment of the present invention. As shown in FIGS. 5(*a*)~5(*c*), the space 11 of the flat plug structure of the present invention can also be positioned below the second conductive plate 30 and parallel to the second conductive plate 30. Furthermore, the flat plug structure further comprises a ground conductive terminal 75.

Figure 6A:
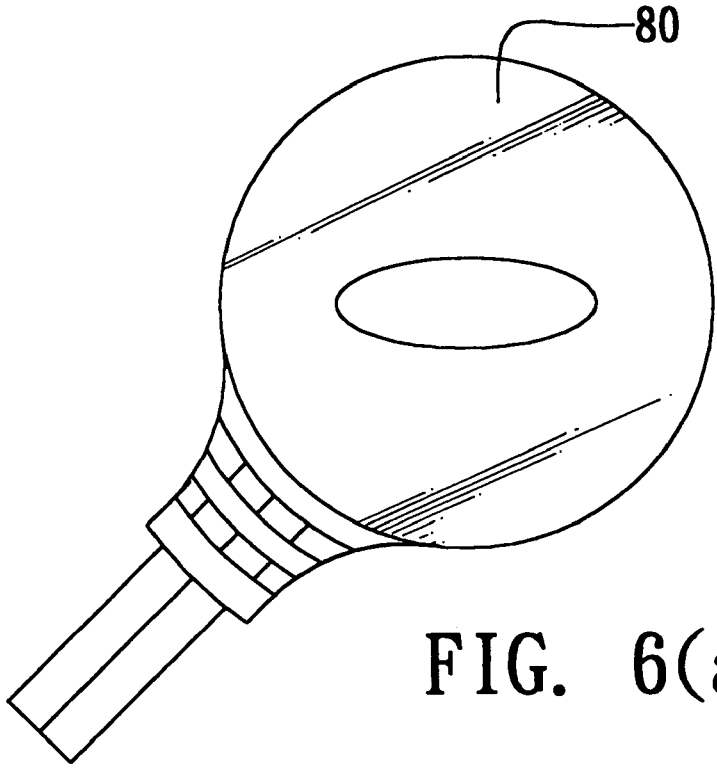
FIGS. 6(*a*)~6(*b*) which respectively shows a top view and bottom view of a flat plug structure in accordance with another embodiment of the present invention.
Figure 6B:
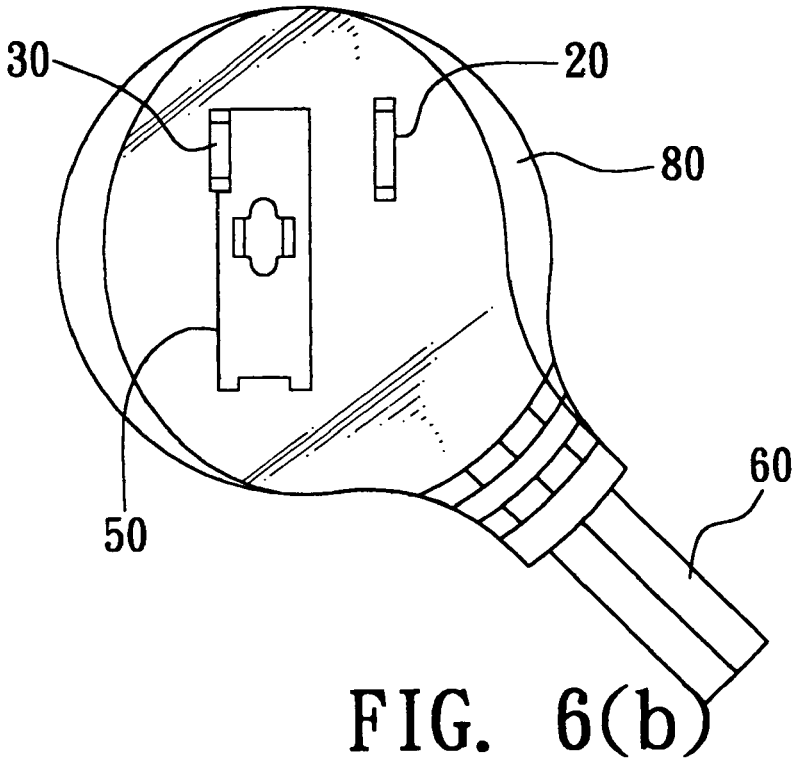

Referring to FIGS. 6(*a*)~6(*b*), which respectively shows a top view and bottom view of a flat plug structure in accordance with another embodiment of the present invention. As shown in FIG. 6(*a*), the flat plug structure of the present invention comprises: a flat housing 80; a first conductive plate 20; a second conductive plate 30; a fuse seat 90 and a bottom plate 50. Wherein, the difference between the embodiment and the first embodiment is that the shape of the flat housing 80 is a round-shaped or a oval-shaped and the space 81 also can be located beside or below the second conductive plate 30 and parallel to the second conductive plate 30. Whereby, when the flat plug is inserted into the outlet, it has a specific angle for example but not limited to 45 degrees it will not block the other outlets. Wherein, the first conductive plate 20 and the second conductive plate 30 have the same structure with the first conductive plate 20 and the second conductive plate 30 of the first embodiment. The bottom plate 50 is made by an insulator for example but not limited to plastic, for carrying the fuse seat 90 and can be removable covered the space 81.

Figure 7A:
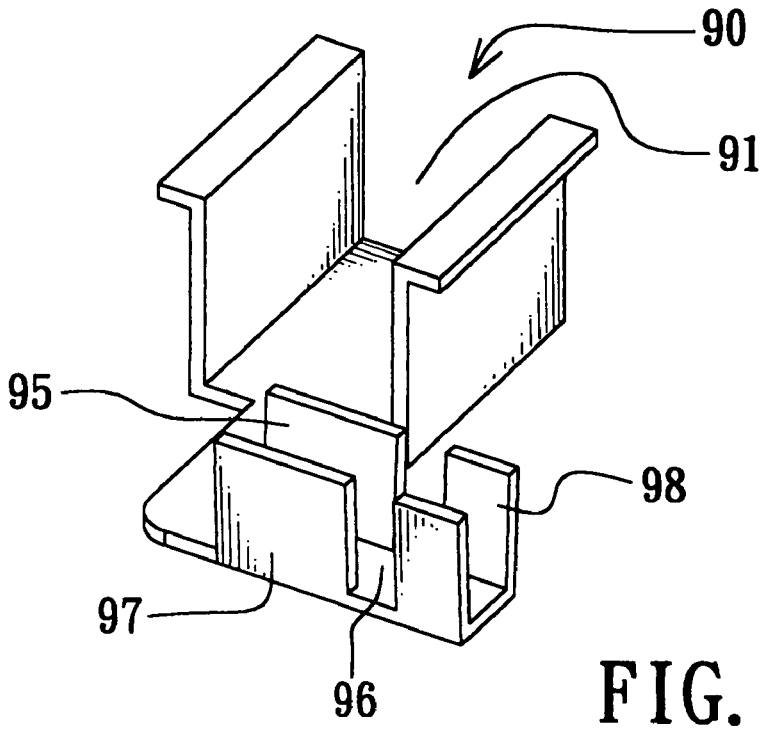
FIGS. 7(*a*)~7(*b*) which respectively shows a top view, side view and bottom view of the fuse seat in accordance with another embodiment of the present invention.
Figure 7B:
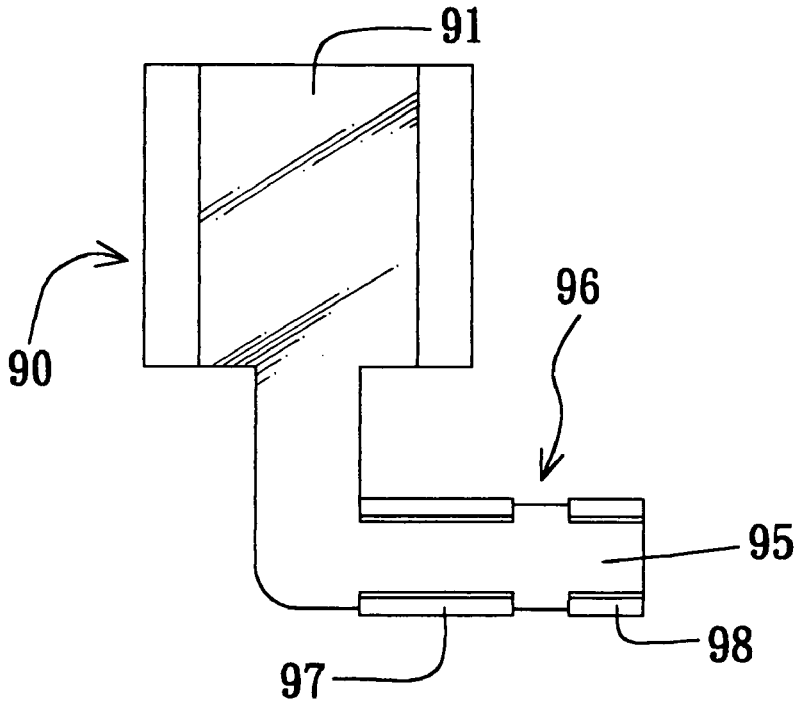

Referring to FIGS. 7(*a*)~7(*b*), which respectively shows a top view, side view and bottom view of the fuse seat 90 in accordance with another embodiment of the present invention. As shown in FIGS. 7(*a*)~7(*b*), the fuse seat 90 of the present invention is positioned inside the space 81 and beside the second conductive plate 30, which comprises a third containing slot 91 and a fourth containing slot 5, wherein, the third containing slot 91 is used to contain and fix a second end of said fuse 70, and said fourth containing slot 95 is used to contain and fix a second conductive wire 62 of said power cable 60. The third containing slot 91 is a U-shaped, and extends forward from the approximately central of the U-shaped bottom to form a U-shaped fourth containing slot 95, and two walls of said fourth containing slot 95 respectively has a opening 96, thus, each walls of said fourth containing slot 95 respectively has a first clip 97 and a second clip 98 so as to fasten said second conductive wire 62 of said power cable 60 by said first clip 97 and second clip 98. Furthermore, the widths of said first containing slot 21, second containing slot 31 and third containing slot 91 are about equal and bigger than the width of said fourth containing slot 95.

Figure 8:
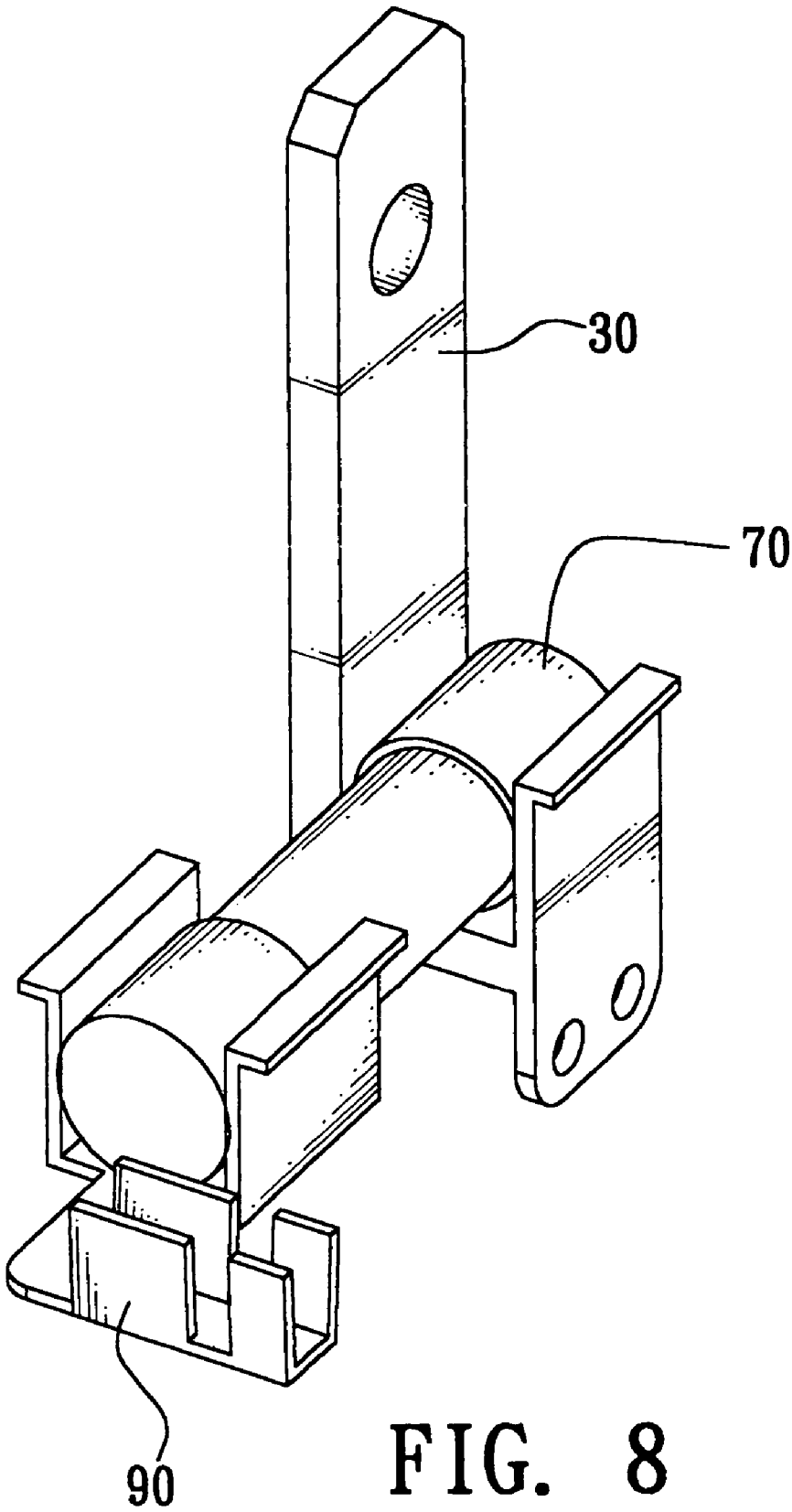
FIG. 8 which shows a combination view of the fuse seat, second conductive plate and the fuse in accordance with another embodiment of the present invention.

Referring to FIG. 8, which shows a combination view of the fuse seat 40, second conductive plate 30 and the fuse 70 in accordance with another embodiment of the present invention. As shown in FIG. 8, During assembling, one end of the fuse 70 can be positioned inside the second containing slot 31; another end of the fuse 70 is positioned inside the third containing slot 91; and the second conductive wire 62 of said power cable 60 is positioned inside the fourth containing slot 95 and fastened by said first clip 97 and second clip 98; finally, the bottom plate 50 covers the space 81 so that the flat plug is completely assembled.

Figure 9:
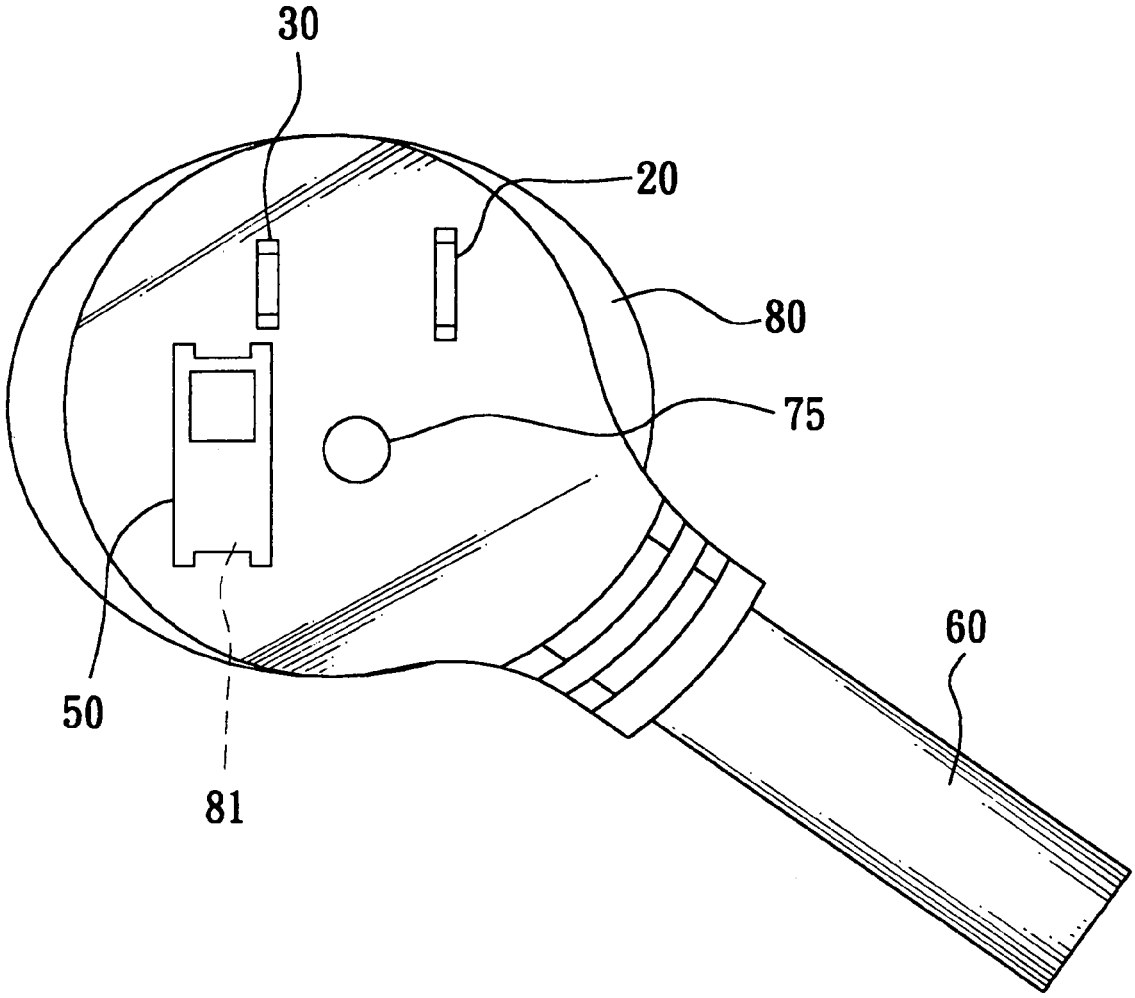
FIG. 9, which shows a view of a flat plug structure in accordance with the other embodiment of the present invention.

Referring to FIG. 9, which shows a view of a flat plug structure in accordance with the other embodiment of the present invention. As shown in FIG. 9, the space 81 of the flat plug structure of the present invention also can be located below the second conductive plate 30 and parallel to the second conductive plate 30. Whereby, when the flat plug is inserted into the outlet, it has a specific angle for example but not limited to 45 degrees it will not block the other outlets. Furthermore, the flat plug structure further comprises a ground conductive terminal 75.

While the invention has been described with reference to a preferred embodiment thereof, it is to be understood that modifications or variations may be easily made without departing from the spirit of this invention, which is defined by the appended claims.

What is claimed is:

1. A flat plug structure comprising:

a) a flat housing having a space located in a bottom surface thereof;

b) a power cable protruding from the housing and having first and second conductive wires;

c) a fuse removable inserted into the space;

d) a first conductive plate protruding from the bottom surface of the flat housing perpendicular to the fuse and having a first containing slot containing and fixing the first conductive wire of the power cable;

e) a second conductive plate protruding from the bottom surface of the flat housing perpendicular to the fuse and having a second containing slot containing and fixing a first end of the fuse, the first conductive plate is parallel to the second conductive plate, the first conductive plate and the second conductive plate are spaced apart a predetermined distance;

f) a fuse seat located in the space and having:

i) a third containing slot containing and fixing a second end of the fuse; and ii) a fourth containing slot containing and fixing the second conductive wire of the power cable; and g) a bottom plate made of an insulative material and selectively covering the space and the fuse seat in the bottom surface of the housing, wherein the first containing slot is located between the first conductive plate and a first side wall spaced apart from the first conductive plate, an end of the first conductive plate is connected to the first side wall by a first bottom wall, the first containing slot having a predetermined width for selectively accommodating the first conductive wire, wherein the second containing slot is located between the second conductive plate and a second side wall spaced apart from the second conductive plate, an end of the second conductive plate is connected to the second side wall by a second bottom wall, the second containing slot having a predetermined width for selectively accommodating the fuse, the first end of the fuse engaging the second conductive plate and the second side wall.

2. The flat plug structure according to claim 1, wherein the flat housing, the first conductive plate, and the second conductive plate are made by a molding method.

3. The flat plug structure according to claim 1, wherein the first containing slot, the second containing slot, and the third containing slot have equal widths.

4. The flat plug structure according to claim 1, wherein the third containing slot is connected to the fourth containing slot and has a U-shaped cross-section, the fourth containing slot includes a first clip and a second clip connected to the second conductive wire of the power cable.

5. The flat plug structure according to claim 1, wherein the flat housing has a rectangular shape.

6. The flat plug structure according to claim 1, wherein the a power cable protrudes from the housing parallel to the fuse.

7. The flat plug structure according to claim 1, wherein the a power cable protrudes from the housing at a 45 degree angle relative to the fuse.

8. The flat plug structure according to claim 1, wherein the second conductive plate has a cross section having a long side and a short side, the space is located adjacent to and parallel with the long side.

9. The flat plug structure according to claim 1, wherein the second conductive plate has a cross section having a long side and a short side, the space is located adjacent to the short side and parallel with the long side.

10. The flat plug structure according to claim 1, further comprising a ground conductive terminal protruding from the bottom surface of the flat housing.

* * * * *